US006257036B1

(12) United States Patent
Iura

(10) Patent No.: US 6,257,036 B1
(45) Date of Patent: Jul. 10, 2001

(54) METALLIC SHAFT MATERIAL DIAMETER INCREASING DEVICE

(76) Inventor: Tadashi Iura, 172-4 Befucho, Matsuyama-shi, Ehime, 791-8056 (JP)

( * ) Notice: Subject to any disclaimer, the term of this patent is extended or adjusted under 35 U.S.C. 154(b) by 0 days.

(21) Appl. No.: 09/508,192

(22) PCT Filed: Jun. 30, 1999

(86) PCT No.: PCT/JP99/03544

§ 371 Date: May 16, 2000

§ 102(e) Date: May 16, 2000

(87) PCT Pub. No.: WO00/02682

PCT Pub. Date: Jan. 20, 2000

(30) Foreign Application Priority Data

Jul. 9, 1998 (JP) ..... 10-211904

(51) Int. Cl.[7] ..... B21K 23/04
(52) U.S. Cl. ..... 72/110
(58) Field of Search ..... 72/80, 84, 111, 72/298, 299

(56) References Cited

FOREIGN PATENT DOCUMENTS

| | | |
|---|---|---|
| 57-22840 | 2/1982 | (JP) . |
| 59-130641 | 7/1984 | (JP) . |
| 59-206134 | 11/1984 | (JP) . |
| 6-65423 | 8/1994 | (JP) . |

*Primary Examiner*—Lowell A. Larson
(74) *Attorney, Agent, or Firm*—Armstrong, Westerman, Hattori, McLeland & Naughton, LLP

(57) ABSTRACT

An apparatus of diametrically expanding a desired portion of a metal shaft, including a driver section (5) which is rotatively driven by an electric motor with a workpiece held in a first sleeve thereof, a driven section (30) having a second sleeve located opposite to the first sleeve of the driver section (5), the driven section (30) being capable of relative movement to and from the driver section (5); a feeder unit (50) for effecting the relative movement of the driven section (30) to and from the driver section (5); a bias means (80) for causing the second sleeve to decline with respect to the axis of the first sleeve of the driver section (5); and a press unit (70) for pressing the driven section (30) toward the driver section (5).

5 Claims, 16 Drawing Sheets

METALLIC SHAFT MATERIAL DIAMETER INCREASING DEVICE

FIELD OF THE INVENTION

The present invention relates generally to a metallurgical process apparatus, and more particularly to an apparatus of diametrically expanding a desired portion, such as a middle portion, of steel or any other metal shafts, so as to cut threads to form gears and cams in the expanded portion.

BACKGROUND ART

It is common practice to obtain a metal shaft having a partly increased diameter by machining a blank shaft of a relatively large diameter. However, this machining process takes time, and what is worse, wastes metal in the form of cutting chips.

In general, the mechanical power transmission shafts require components such as gears, cams, and sprockets whose diameter is larger than that of the shafts. In order to provide the metal shafts with these components, a mechanical method is not economical where the metal flesh of a shaft is machined to form gears as integral parts. An alternative way is to produce those component parts on a separate process, and then join them to the shafts by welding or bolting. This method is not efficient. Therefore, a metallurgical process was proposed for forcing a metal shaft to diametrically expand in a desired portion, and cutting gears or cams there. However, it has been considered to be impracticable to put the proposed metallurgical method in practice.

The inventor of the present application invented a method of expanding the diameter of a metal shaft in its middle portion through rotation, bending and compression, and has obtained Japanese Patent No. 1,993,956. This metallurgical method has overshadowed the conventional mechanical method, and made it possible to form gears or cams in the diametrically expanded portion of a metal shaft.

Nevertheless, the patented method is at the experimental stage, and is not fully developed for mass-production basis. The present invention has overcome the obstacles to practical use.

SUMMARY OF THE INVENTION

According to the present invention, there is an apparatus of expanding a diameter of a metal shaft in a desired portion, the apparatus including a driver section which is rotatively driven by an electric motor with a workpiece held in a first sleeve; a driven section having a second sleeve located opposite to the first sleeve of the driver section, the driven section being capable of relative movement to and from the driver section; a feeder unit for effecting the relative movement of the driven section to and from the driver section; a bias means for causing the second sleeve to decline with respect to the axis of the first sleeve of the driver section; and a press unit for pressing the driven section toward the driver section.

In performing the diametral expansion of a metal shaft, the driver section and the driven section are arranged such that the respective sleeves are axially aligned with a workpiece (blank shaft) held therebetween. Then, the driver section is driven to rotate the workpiece, and at the same time, the press unit is driven to compress it axially. At this stage, the bias means causes the portion of workpiece toward the driven section to decline with respect to the axis of the driver section. Preferably, the center of the bent is deviated outward from the center line of the blank shaft. Because of this deviation the bent portion is subjected to constant compression, and as a result, fracture due to fatigue is avoided; otherwise, fracture would be likely to occur the alternate application of compression and tension. In the course of rotation, bending and compression the workpiece is forced to diametrically expand in the portion between the holders of the driver section and the driven section. As the expansion proceeds, the driven section moves toward the driver section, during which compression is continued.

Upon completion of the expansion, the bias means is returned to its original position where the driver section and the driven section are axially aligned. Then the rotation and compression are stopped, and the finished shaft is released.

The press unit can be a fluid cylinder, a hydraulic jack, etc. The bias means can be an arrangement in which, for example, the sleeve of the driven section is pivoted rotatively around its own axis, and is declined by applying a force to it axially at right angle.

After the diameter of the shaft is partly expanded, it must be taken out. However, it often happens that it is difficult to release it from the sleeves because of the remainder of the force applied in the process. In order to overcome this difficulty, an extra remover can be employed, which is provided with a device engageable with the expanded portion of the workpiece.

DETAILED DESCRIPTION OF THE PREFERRED EMBODIMENTS

Figure 1:
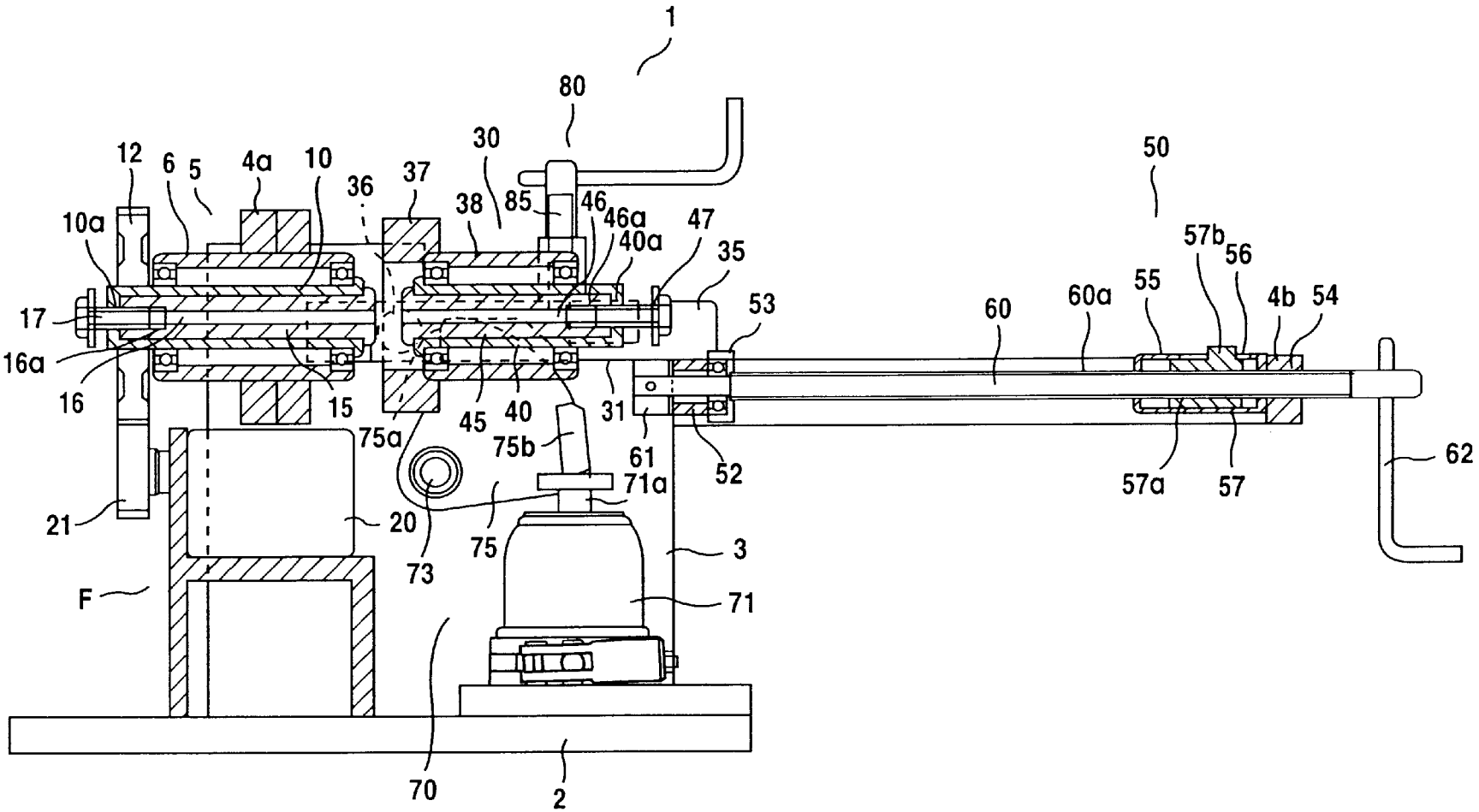
FIG. 1 is a cross-sectional side view of a first embodiment of the present invention.
Figure 2:
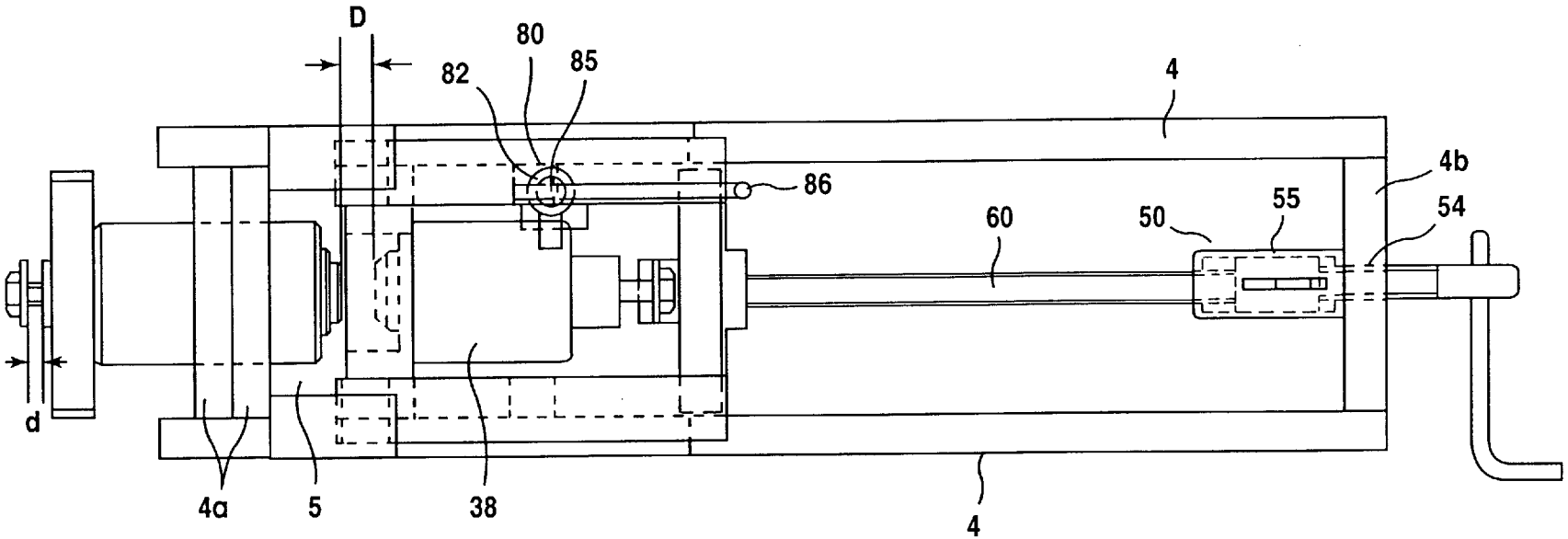
FIG. 2 is a plan view of the first embodiment.

Referring to FIGS. 1 and 2, a first preferred embodiment of the invention will be described:

The diametrically expanding apparatus (hereinafter "apparatus") 1 is provided with a pair of side plates 3 erected on a base 2 anchored in a floor (not shown). A rectangular framework 4 is provided on the side plates 3, and is provided with a driver section 5 in its left-hand end portion. Herein, the "drive" includes "rotate". The driver section 5 includes a holder sleeve 10 rotatively carried on a main sleeve 6 secured to members 4*a* on the framework 4, and the holder sleeve 10 is provided with a driven gear 12 at its end. The holder sleeve 10 houses a chuck sleeve 15 fitted therein so as to hold a workpiece (metal blank shaft). The chuck sleeve 15 includes a bore 16 in its core through which the workpiece fits. The bore 16 includes a female thread section 16*a* at one end with which an extruding screw 17 is engaged through a through-hole 10*a* produced at an end of the holder sleeve 10.

Under the main sleeve 6 is provided a driving motor 20 whose output shaft carries a driving gear 21 which is engaged with the driven gear 12.

A driven section 30 is provided opposed to the driver section 5 which is provided with a slide 35 slidable along a rail 31 provided on the framework 4. The slide 35 is provided with a ring-shaped rotary frame 37 carried by a shaft 36 at one end. The rotary frame 37 has a main sleeve 38 on the driven side, and the main sleeve 38 rotatively houses a holder sleeve 40. The holder sleeve 40 houses a chuck sleeve 45 for holding a workpiece, the chuck sleeve 45 corresponding to the chuck sleeve 5 of the driver section 5. The chuck sleeve 45 includes a bore 46 in its core. The bore 46 includes a female thread section 46*a* at one end with which an extruding screw 47 is engaged through a through-hole 40*a* produced at an end of the holder sleeve 40.

A feeder unit 50 is provided behind the slide 35 so as to move the driven section 30 to and from the driver section 5. The slide 35 is provided with a bracket 52 at its rear end which carries a bearing 53. The framework 4 has a cross-bar 4*b* at its rear end in which a bore 54 is produced, and is provided with a stationary sleeve 55 ahead of the bore 54. The sleeve 55 has a slit 56 extending along its length. The slit 56 houses a slide 57 having a threaded hole 57*a*, the slide 57 having a projection 57*a* projecting through the slit 56. The slide 57 can reciprocally move with its projection 57*a* kept projecting through the slit 56.

A feed rod 60 is supported by the bearing 53 of the bracket 52 and the crossbar 4*b* such that it can rotate around its own axis. The feed rod 60 has male threads 60*a* with which the slide 57 is engaged. The feed rod 60 is prevented by a ring 61 from detaching from the side plate 3, and can be manually rotated by a handle 62.

Under the driven section 30 is provided a press unit 70, which presses the driven section 30 toward the driver section 5, and a hydraulic jack 71 is provided on the base 2. A cam 75 is provided adjacent to the jack 71 such that it can rotate on a cam shaft 73 clockwise or anticlockwise. The cam 75 includes an abutment 75*a* in its front portion which is engageable with a rear portion of the rotary frame 37 of the driven section 30. The cam 75 is provided with a receiving portion 75*b* designed to come into abutment with a piston rod 71*a* of the jack 71 during the rotation of the cam 75 and receive a lifting force from the jack 71.

When the jack 71 is operated, the piston rod 71*a* extends to lift the cam 75. As a result, the cam 75 rotates around the shaft 73 anticlockwise in FIG. 1, and causes the driven section 30 to advance toward the driver section 5. The hydraulic jack 71 can be substituted by a hand-operated jack of a type which is commonly used for lifting a motor car when a tyre is replaced in puncture. Instead of oil, air or any other liquid can be used. An alternative tool can be a known screw jack. Instead of a hand-operated jack, a power jack can be used.

The driven section 30 is provided with a bias means 80 for rotating it clockwise or anticlockwise. The bias means 80 includes a nut 82 secured to the main sleeve 38, and a screw bar 85 engageable with the nut 82. A lower end of the screw bar 85 is in abutment with the slide 35, and is provided with a handle 86 in its upper end. By rotating the handle 86, the screw bar 85 is rotated and allows the nut 82 to move up or down together with the main sleeve 38. In this way the driven section 30 rotates around the shaft 36 clockwise or anticlockwise.

In operating the apparatus 1 the ends of a workpiece (normally a steel shaft) W are insertedly held in the chuck sleeve 15 of the driver section 5 and the chuck sleeve 45 of the driven section 30. The threading amount (length) of the extruding screw 17 is adjusted so as to obtain an optimum extrusion allowance d (FIG. 2). Then the workpiece W is inserted until its end comes into abutment with the end of the extruding shaft 17. The extruding screw 47 of the driven section 30 is adjusted and brought into abutment with the rear end of the workpiece W.

Then the distance between the driver section 5 and the driven section 30 is adjusted by the feeder unit 50 to be a desired distance D. This distance D is a distance required for obtaining a desired expanded diameter in the workpiece W, and it is desirable to ascertain it through a test beforehand. The adjustment is made by advancing the slide 57 (a preliminary movement) by the handle 62 until its projection 57*b* comes into abutment with rear end of the slit 56, and continuing to operate the handle 62 to gradually advance the rod 60. Since the top of the feed rod 60 is integral with the slide 35 of the driven section 30, the driven section 30 is caused to advance along the framework 4. At this stage the workpiece W is loosely held by the chuck sleeves 15 and 45, so that it does not move because its end is kept in abutment with the extruding screw 17.

Figure 3:
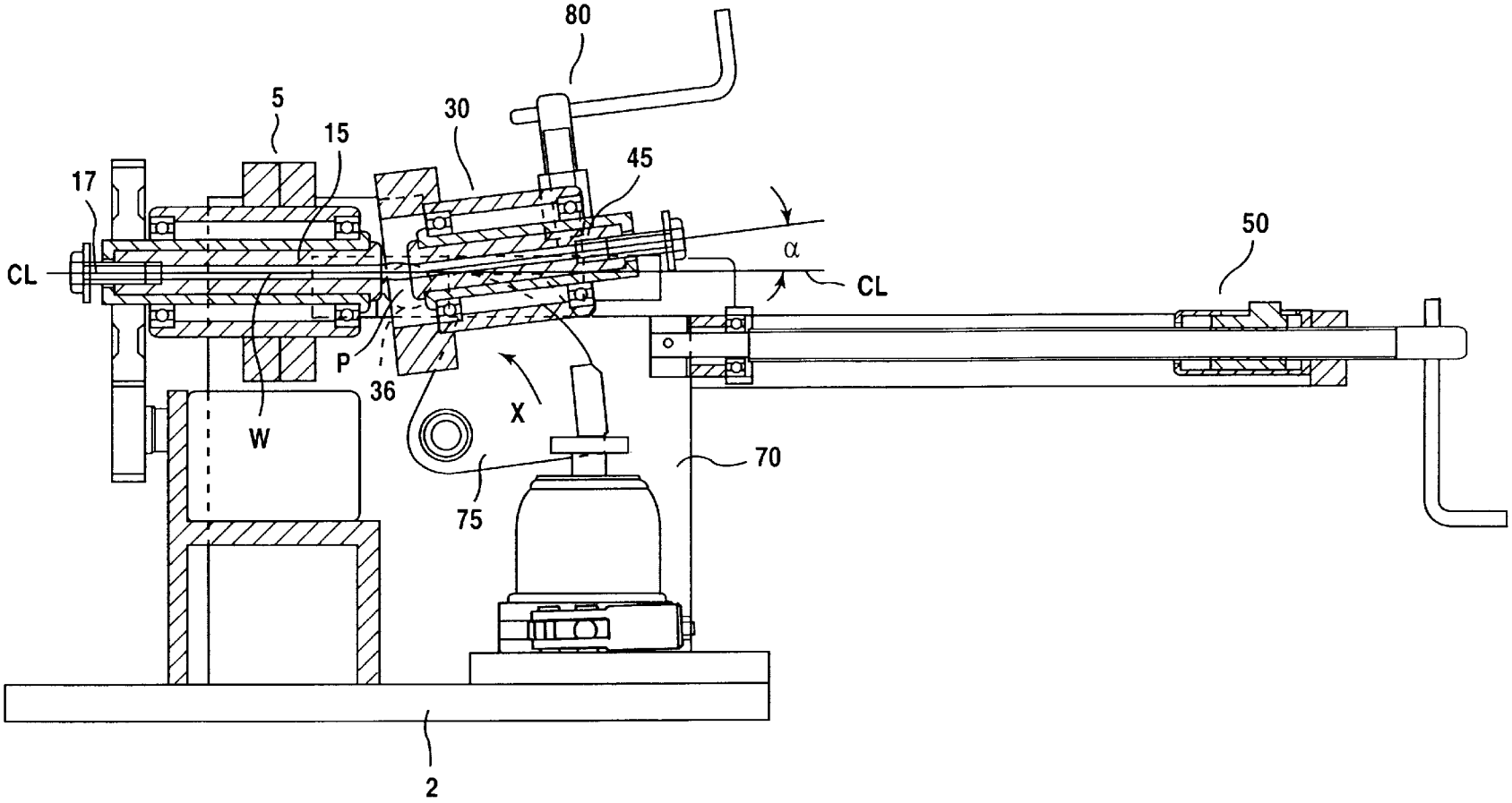
FIG. 3 is a vertical cross-section of a main portion of the first embodiment to illustrate the operation of diametral expansion.

The workpiece W is axially pressed by the press unit 70, and the driven section 30 is declined by the bias means 80 as shown in FIG. 3. Specifically, the press is performed by the jack 71 so as to rotate the cam 75 in the arrow X direction. With the press unit 70 and the bias means 80 kept in operation, the motor 20 is turned on to cause the workpiece W to rotate and become bent under pressure provided by the press unit 70. The rotations per minute can be a few or a few tens, and the bent angle can be at least 3 to 7 degrees. The center P around which the workpiece W is bent is deviated outward from the center line CL of the pre-bent workpiece W. The pressure depends upon the thickness of the workpiece W and any other factor. It is reported that a pressure of 20 to 30% of a uni-axial compressive yield stress in a metal shaft is enough to expand the diameter of a metal shaft ("Study on Diametral Expansion of Round Bars (I)" Volume 34, by Ni'ihama Technical College).

In this way the diametral expansion is performed in a portion of the workpiece W that is located between the chuck sleeves 15 and 45 through compression the the sequence of rotation, bending and pressing. As the diametral expansion continues, the distance between the chuck sleeves 15 and 45 becomes short, and finally both the ends of the expanded portion of the workpiece W come into contact with the end faces of the chuck sleeves 15 and 45. After the desired diametral expansion is achieved, the rotation and pressing are continued, and the bias means 80 is returned to its original state, thereby returning the workpiece W to its original straight position. In this way a straight metal shaft having an expanded diameter is obtained. The rotation and pressing are stopped, and the workpiece W is released from the chuck sleeves 15 and 45.

Figure 12:
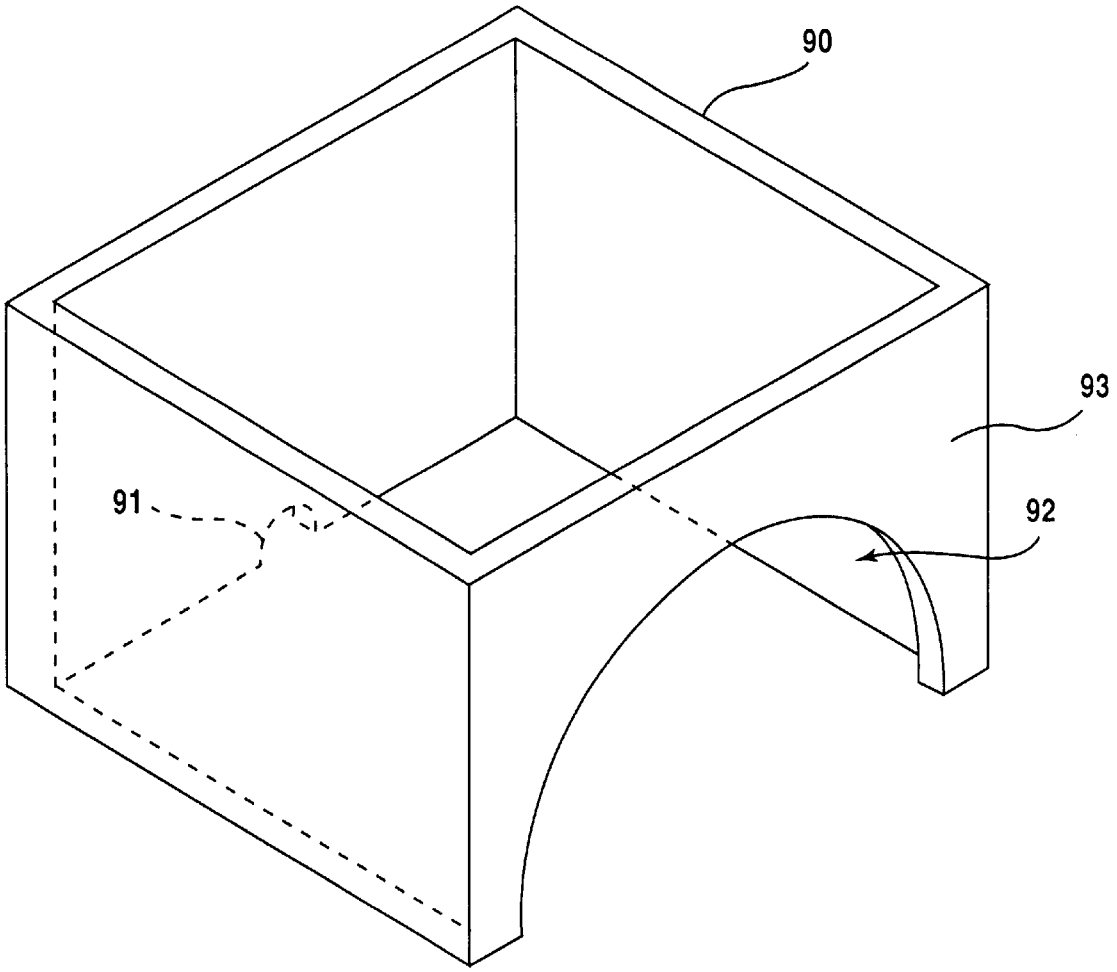
FIG. 12 is a perspective view showing a remover whereby, subsequent to the diametral expansion, a finished workpiece is released.

At first, the workpiece W is loosely held by the chuck sleeves 15 and 45 so that the diametral expansion does not extend to an undesired portion of the workpiece. However, it often happens that since the workpiece W becomes too tightly held by the chuck sleeves during the rotation, bending and pressing, it is difficult to remove from the chucks. In this case, the extruding screw 17 is inserted and pushes the workpiece W on the end thereof so that it is pushed by the distanced to allow a gap corresponding to the allowance d between the ends of the expanded diameter and the end faces of the chuck sleeves. A remover 90 shown in FIG. 12 is used by fitting a recess 91 of the remover 90 into the gap d, thereby enabling the remover 90 to come into engagement with the diametrically expanded portion G. Then the workpiece W can be drawn in the right-hand direction in FIG. 1. The remover 90 is provided with a semi-circular recess 92 complementary with the contour of the main sleeve 6, and with an engaging side 93 which is engageable with the back of the rotary frame 37. When the workpiece W is to be drawn, the engaging side 93 is kept in engagement with the rotary frame 37, and the feeder unit 50 is reversely rotated.

Figure 4:
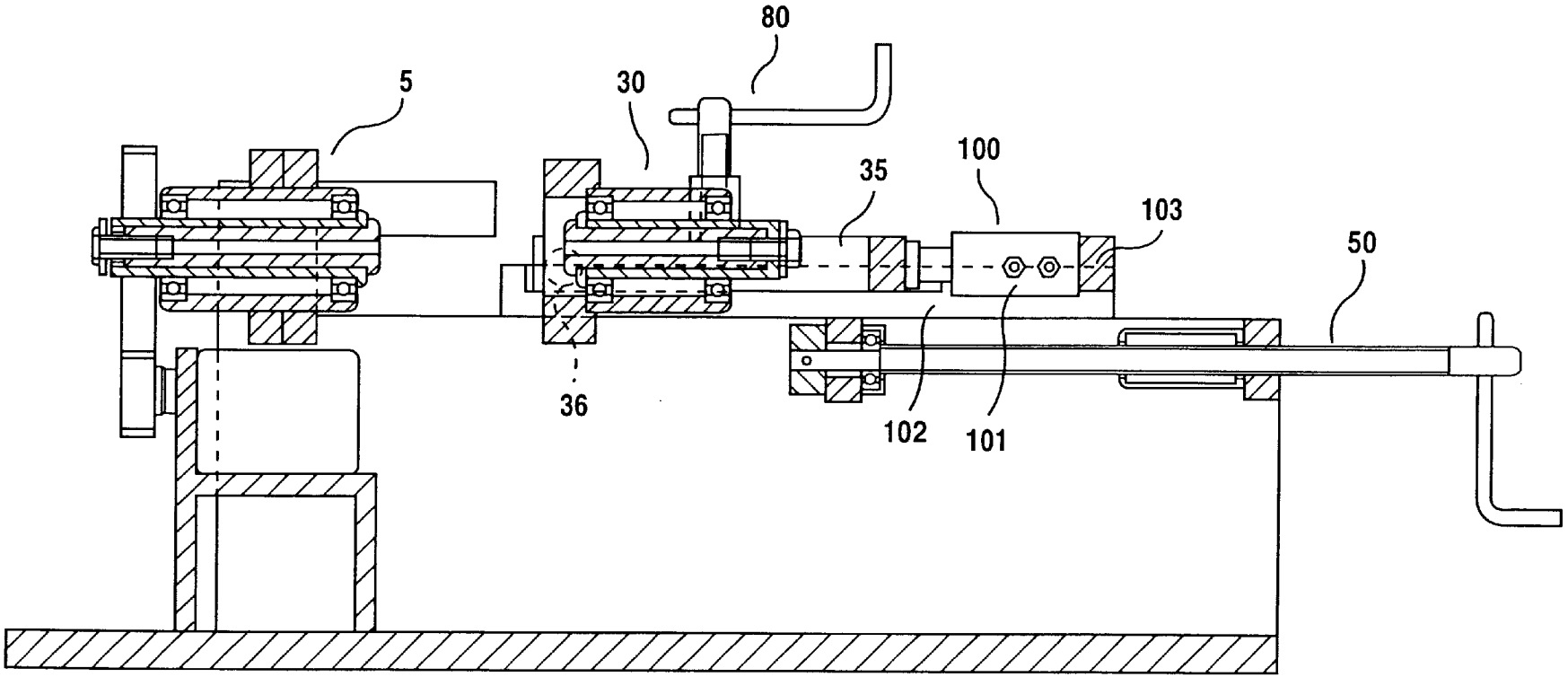
FIG. 4 is a cross-sectional side view of a second embodiment.
Figure 5:
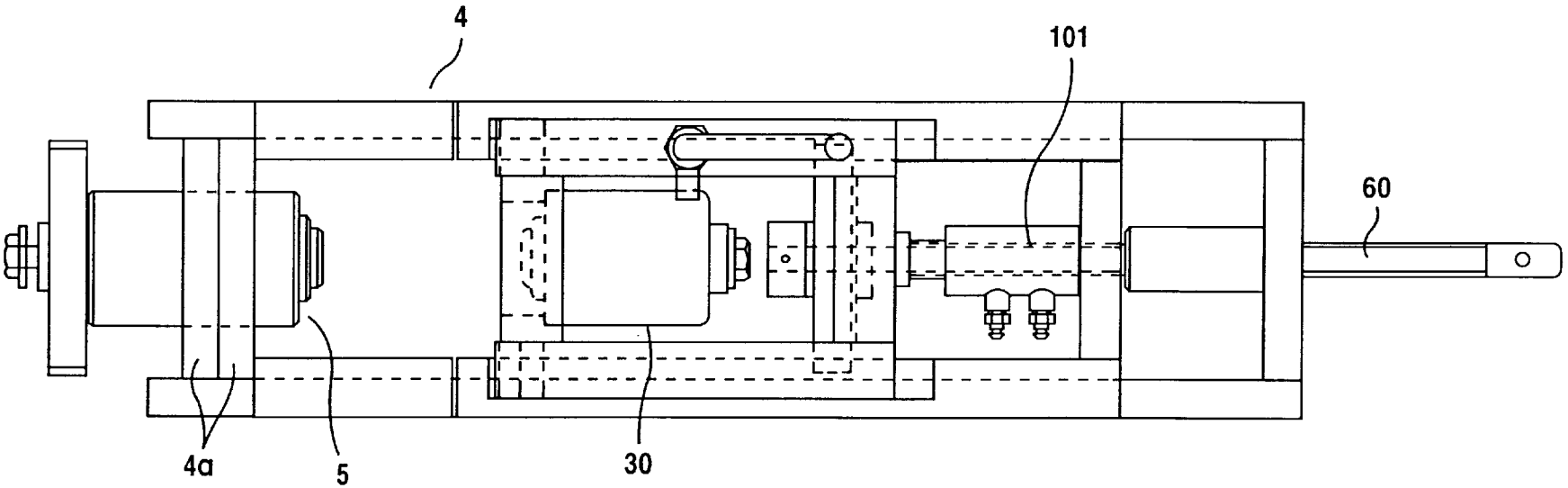
FIG. 5 is a plan view of the second embodiment.
Figure 6:
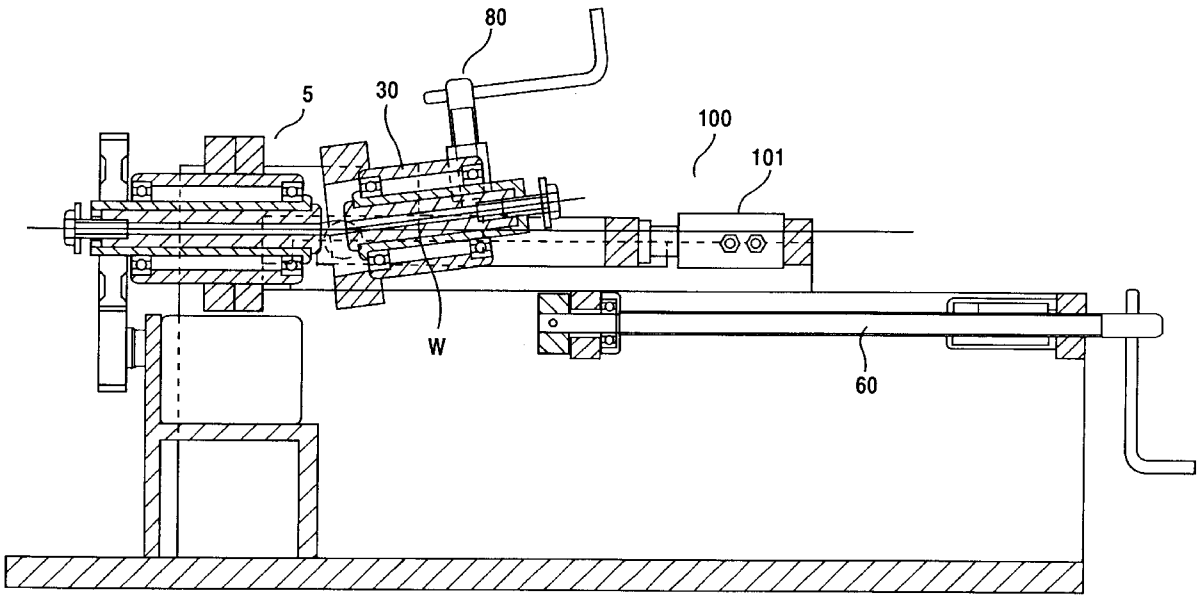
FIG. 6 is a vertical cross-section of a main portion of the second embodiment to illustrate the operation of diametral expansion.
Figure 7:
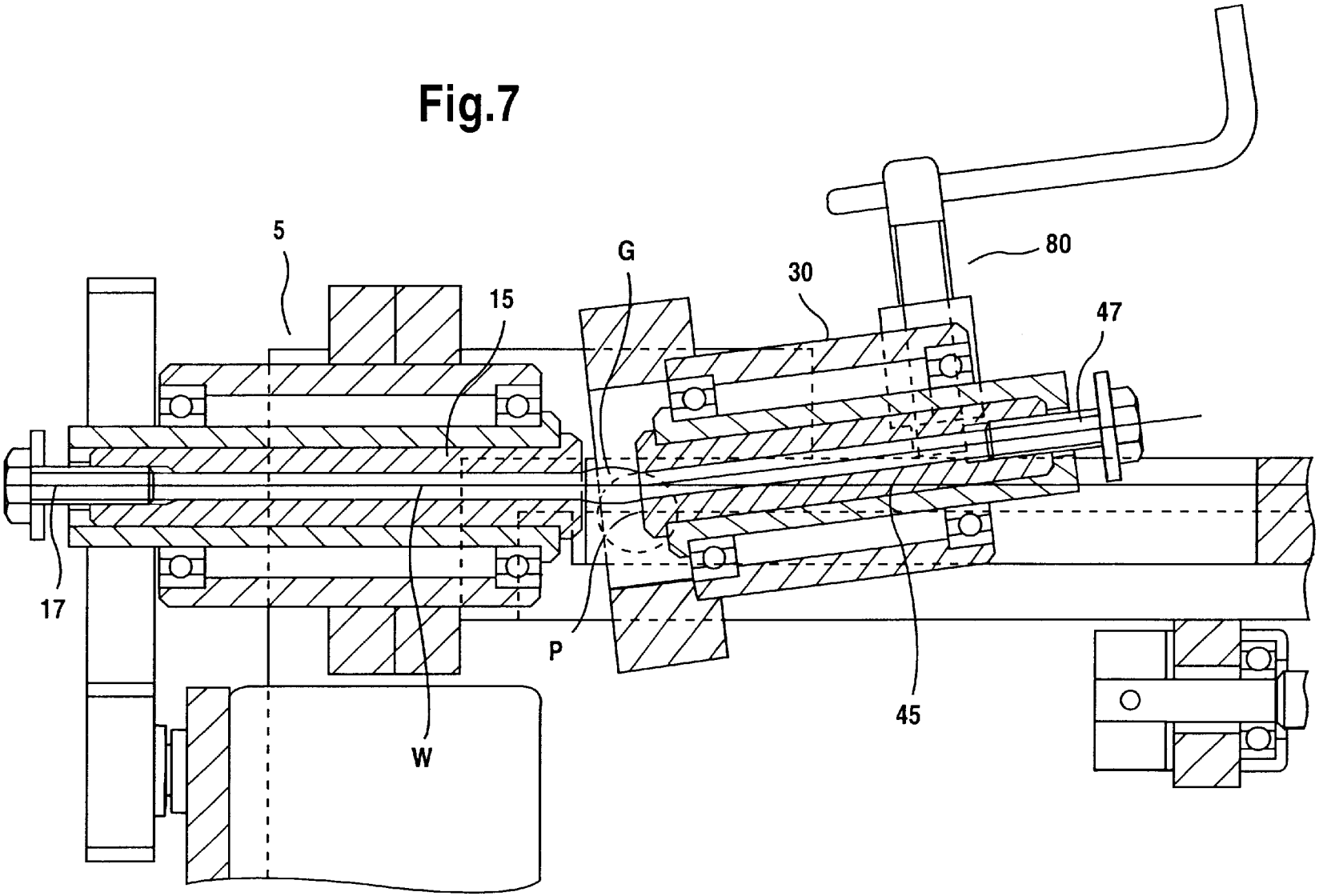
FIG. 7 is a cross-section of a main portion of the second embodiment.
Figure 8:
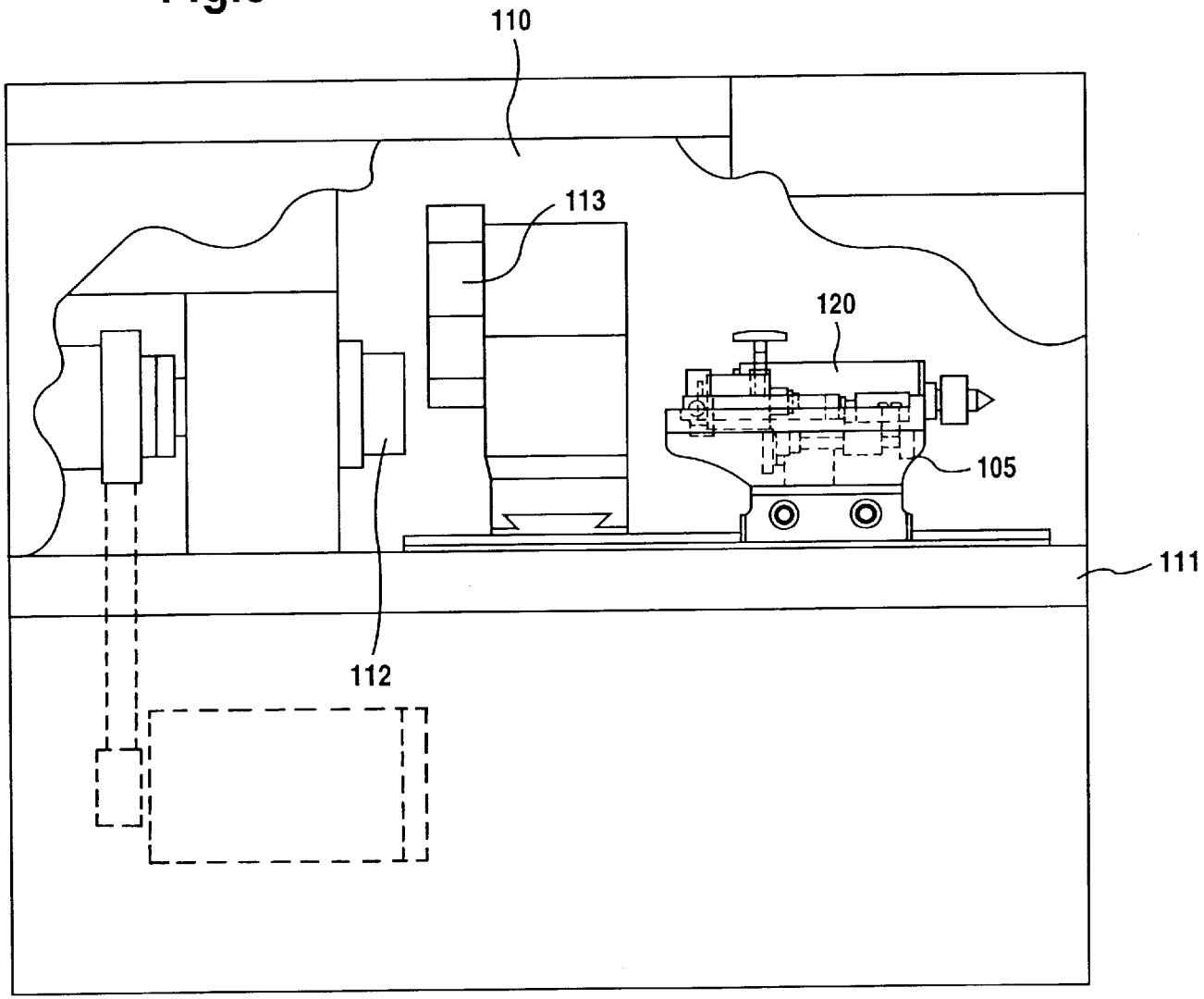
FIG. 8 is a schematic view exemplifying a third embodiment.
Figure 9:
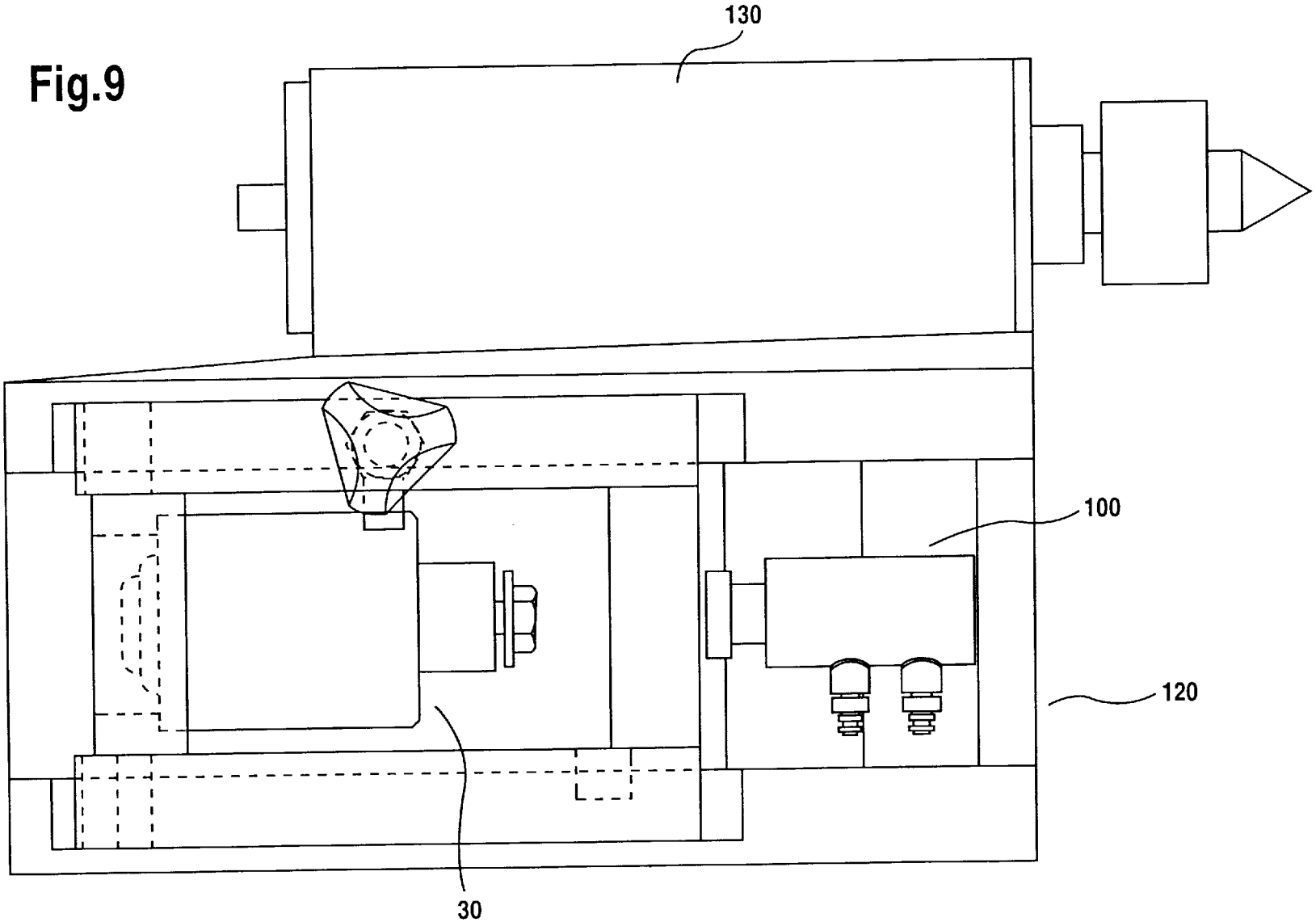
FIG. 9 is a plan view of an expanding unit employed in the third embodiment.
Figure 10:
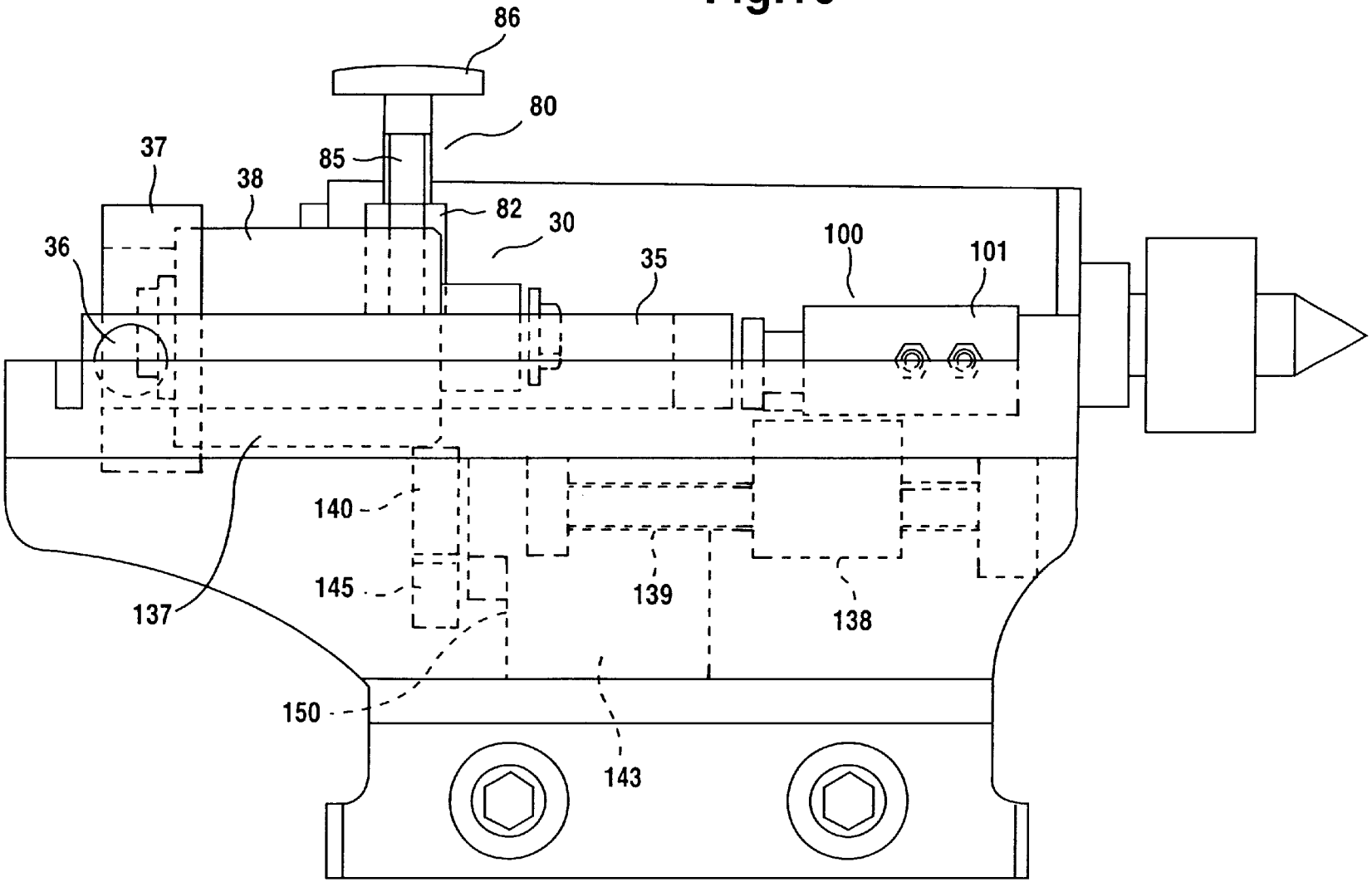
FIG. 10 is a side view of the expanding unit of FIG. 9.

By referring to FIGS. 4 to 6, a second preferred embodiment will be described:

This embodiment is different from the first version in that the press unit 100 is a double hydraulic cylinder type 101 (hereinafter, "double cylinder") instead of the hydraulic jack 71 and the cam 75 used in the first embodiment. More specifically, the slide 35 of the driven section 30 is slidably mounted on a second slide 102 which slides on the framework 4. The feeder rod 60 of the feed unit 50 is connected to the second slide 102, and moves the driven section 30 together with 30 forward and backward. The double cylinder 101 is located between the rear frame 103 of the second slide 102 and the slide 35, and pushes the slide 35 forward. The other components are the same, and function in the same manner, so that like reference numerals designate like elements and components in the first embodiment.

Figure 13:
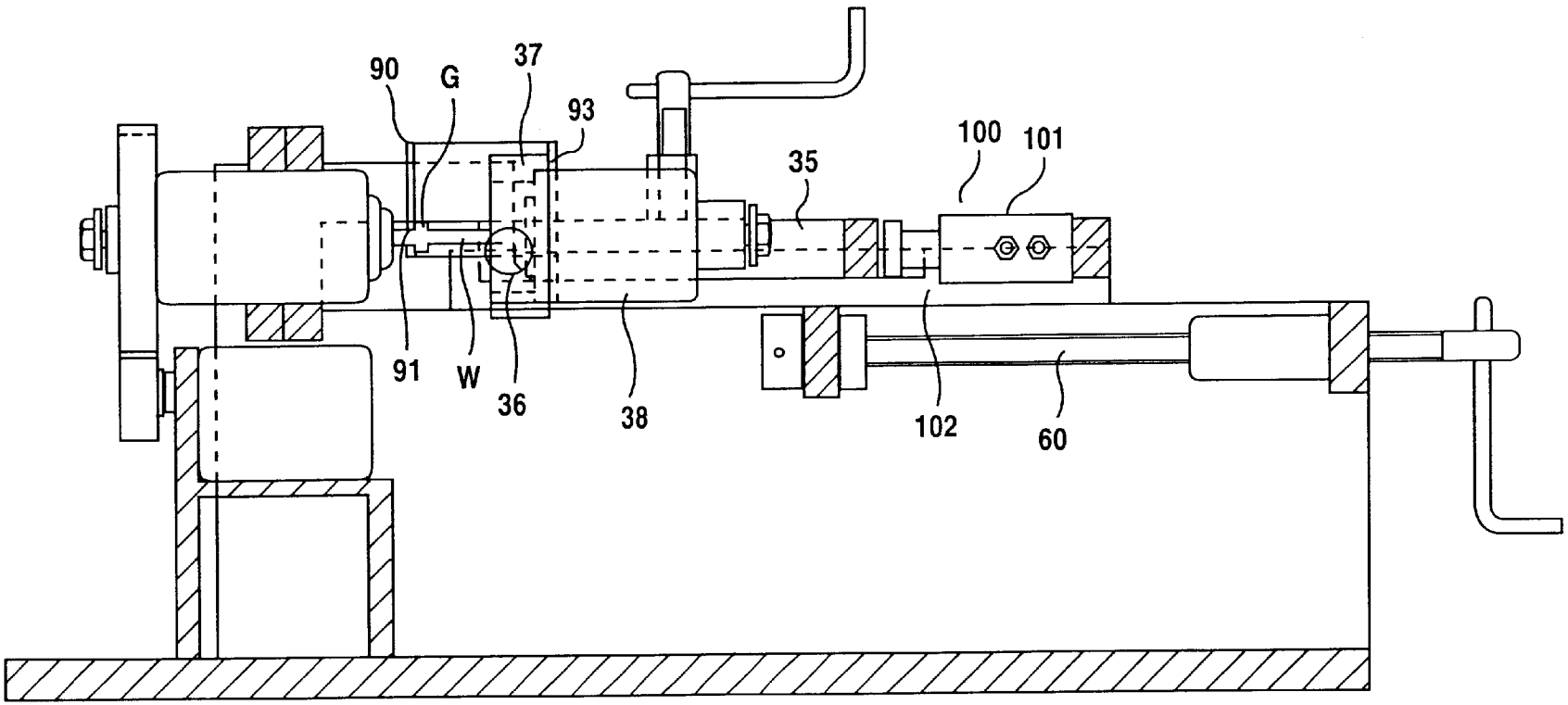
FIG. 13 is a side view of the apparatus using the remover to release a finished workpiece.
Figure 14:
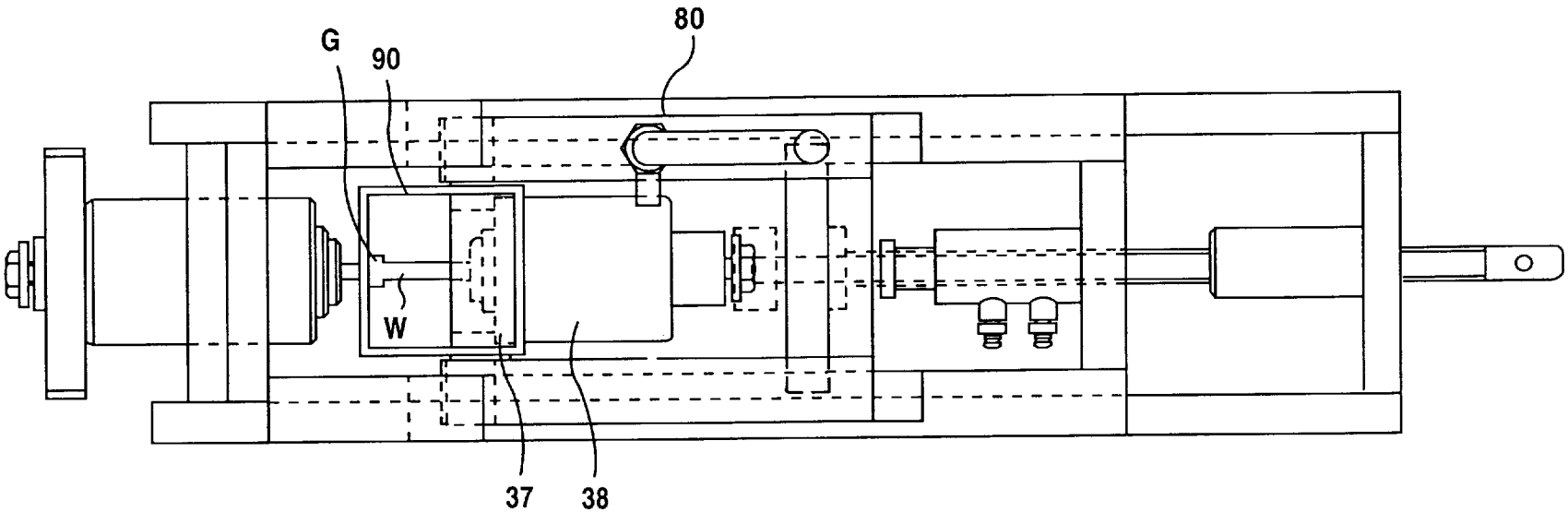
FIG. 14 is a plan view of the situation shown in FIG. 13.

An advantage of the second embodiment is that since the driven section 30 is directly pushed by the double cylinder 101 without the use of the hydraulic jack 71 and the cam 75, the overall structure can be simple and a high efficiency is achieved in the power transmission. The double cylinder 101 is convenient in that it can be used for drawing the workpiece after the diametral expansion is finished. FIGS. 13 and 14 illustrate a manner of drawing the workpiece subsequently to the diametral expansion. The extruding screw 17 is driven until the workpiece is slightly extrude from the chuck sleeves 15 and the recess 91 of the remover 90 (FIG. 12) is engaged with the diametrically expanded portion G. Then the engaging side 93 of the remover 90 is placed face to face with the rotary frame 37. In this situation the feeder unit 50 is reversely operated to move the driven section 30 backward, and cause the remover 90 to draw the workpiece out of the chuck sleeve 15 of the driver section 5. The other end of the workpiece is easily drawn out of the chuck sleeve 45 of the driven section 30 by hand.

Referring to FIGS. 8 to 11, a third preferred embodiment will be described:

This embodiment is characteristic in that the apparatus 110 is incorporated in a conventional lathe; the illustrated lathe 111 is a known NC (numerical control) lathe having a tailstock 105. More specifically, the expanding unit 120 is incorporated in the tailstock 105. The apparatus 110 includes a chuck 112 which also functions as a driver section, and a tool holder 113.

Figure 11:
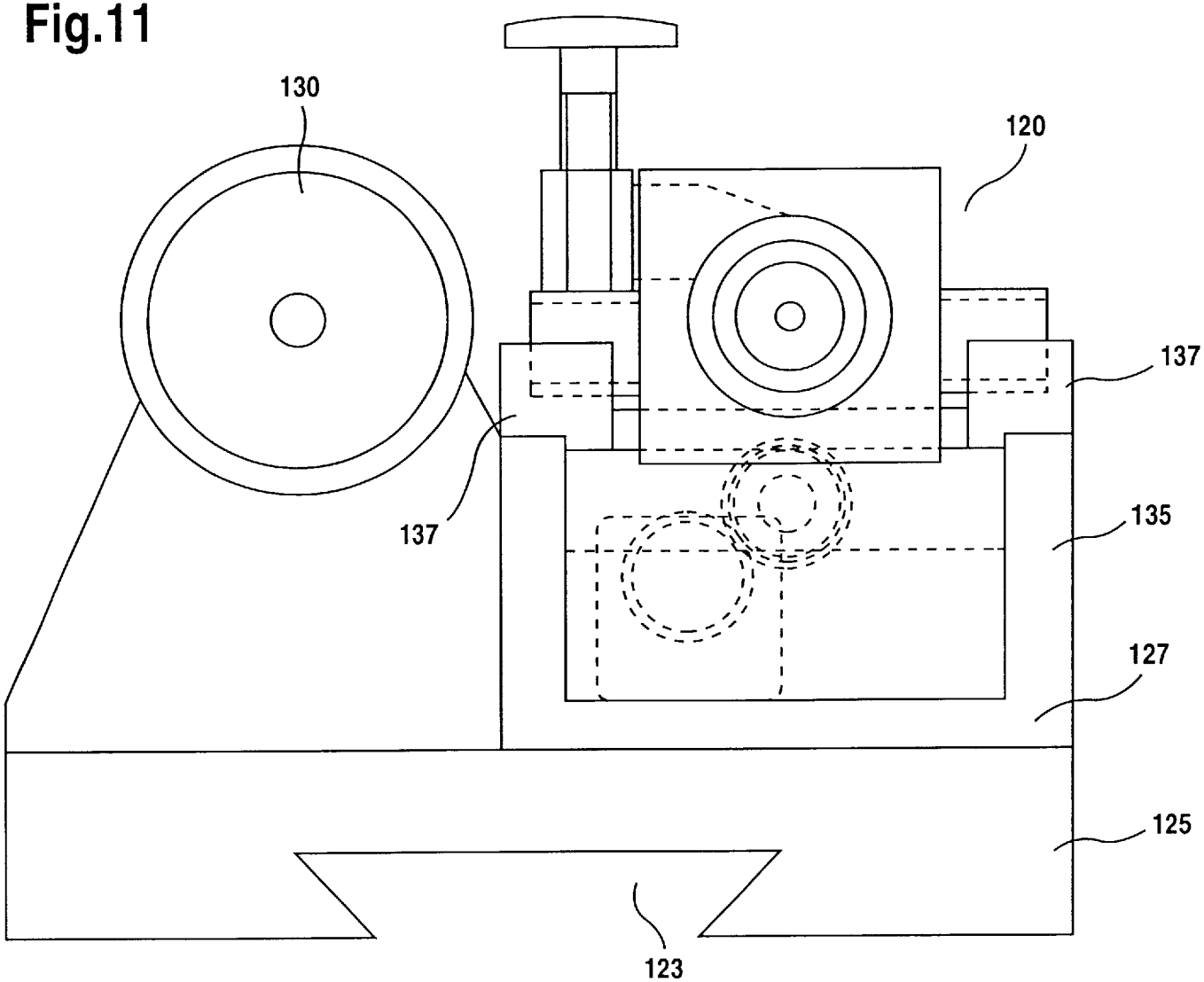
FIG. 11 is a front view of the expanding unit of FIG. 9.

Referring to FIG. 11, the expanding unit 120 includes a base 125 having a dovetail mortise 123, and a rotor 127 on which a tailstock 130 and the expanding unit 120 are arranged side by side. By turning the rotor 127 at 180° the expanding unit 120 or the tailstock 130 is caused to face the chuck 112.

The expanding unit 120 includes a pair of slides 137 slidably mounted on the upright sides of a frame 135, each slide 137 having a block 138 secured thereto. The block 138 has a threaded hole axially produced, and a screw bar 139 therethrough with the respective threads being in engagement. The screw bar 139 is part of the feeder unit 150, and is provided with a driven gear 140 at one end. The frame 135 houses a feeder motor 143 whose shaft carries a driver gear 145 in engagement with the driven gear 140. The rotation of the motor 143 clockwise or anticlockwise causes the rotor 138 to move forward and backward together with the second slide 137 along the screw bar 139. Instead of the power-driving feed, a manually-operated feeder can be employed.

The second slide 137 is equally provided with the driven section 30. More specifically, the slide 35 of the driven section 30 is slidably mounted on the second slide 137 to which the rotary frame 38 is joined by means of the shaft 36. The other components of the driven section are the same as those described above.

The bias means 80 is the same as those used in the first and second embodiment; it is provided with the nut 82, and the screw bar 85 mating with the nut 82. The screw bar 85 is in abutment with the slide 85 at its lower end, and is provided with a handle 86 at its upper end. By turning the handle 86, the screw bar 85 is rotated but does not ascend or descend. Because of the joint between the lower end of the screw bar and the slide 35, the nut 82 moves up or down together with the main sleeve 38. In this way the driven section 30 rotates clockwise or anticlockwise together with the shaft 36.

The press unit 100 composed of a hydraulic cylinder 101 can be used, as in the second embodiment. The hydraulic cylinder 101 is in abutment with the frame of the second slide 137, and its piston rod is intended to push the slide 35.

In expanding the diameter of the metal shaft by means of the expanding unit 120, one end of the metal shaft is held by the chuck mounted on the head of the lathe, and the other end of it by the chuck sleeve 45 of the driven section 35.

The driven section 35 is moved by the motor 143 of the feeder unit 150. In this way the rotation, bending and compression are performed to diametrically expand the metal shaft in the same manner as the first and second embodiments.

This expanding apparatus 100 is incorporated in a known lathe, and the rotation provided by the head of the lathe can be used in place of the the driver section described above. By substituting the lathe for the driver section, the structure of the apparatus is simplified only with the provision of the other components, thereby reducing the cost and size of the apparatus. In the illustrated example the expanding unit 120 is associated with a tailstock, which is indispensable to the lathe. By turning the rotor 127 clockwise or anticlockwise, the tailstock or the expanding unit can be switched over. It is also possible to use the expanding unit as an ancillary tool where it is not associated with the tailstock.

Figure 15:
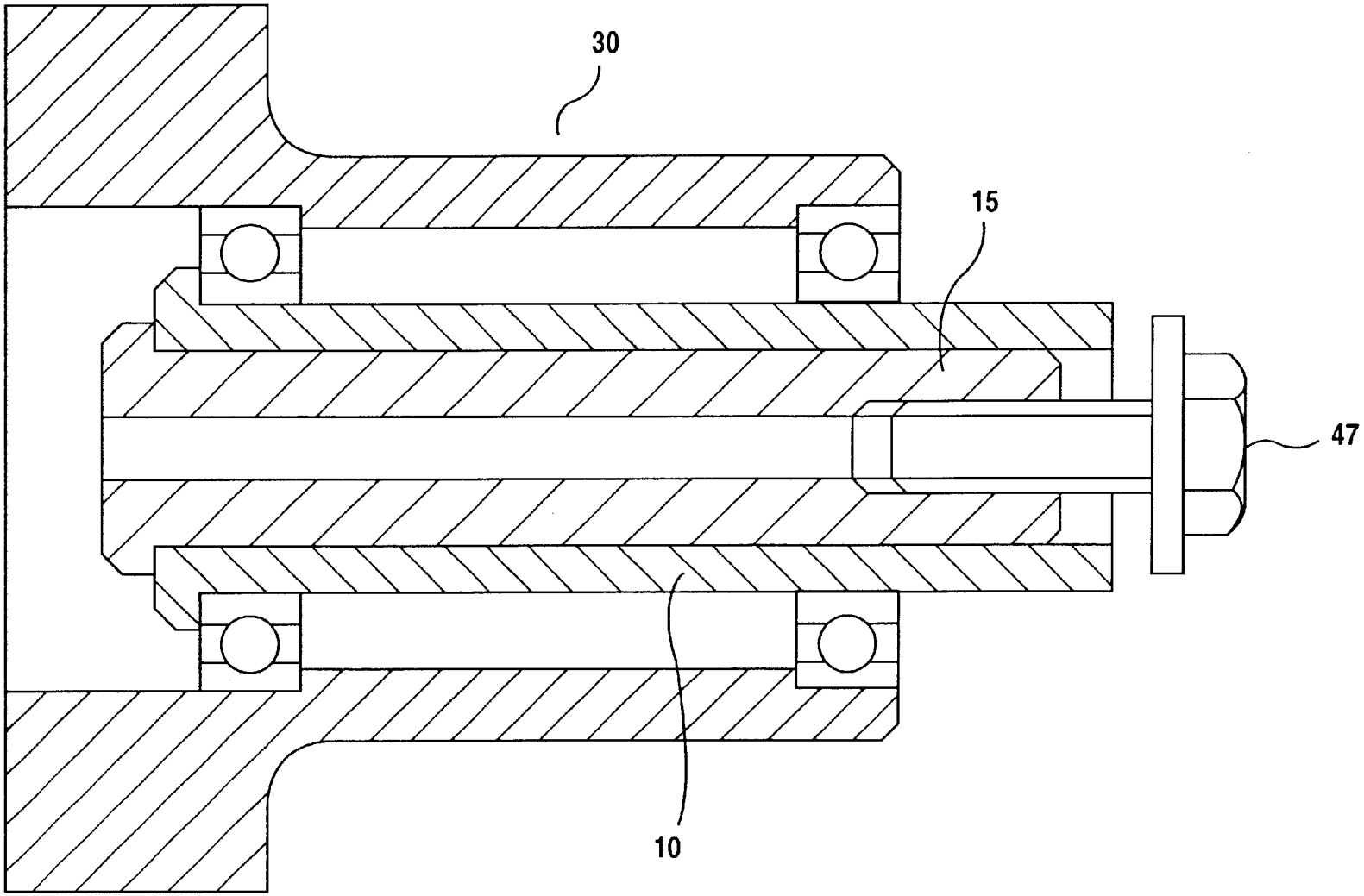
FIG. 15 is a cross-section of a chuck sleeve employed in a different embodiment.

In the embodiments referred to above the chuck sleeve has a bore of an equal diameter but its shape is not limited to a particular shape or size. The driven section shown in FIG. 15 has a chuck sleeve which can be easily replaced.

Figure 16:
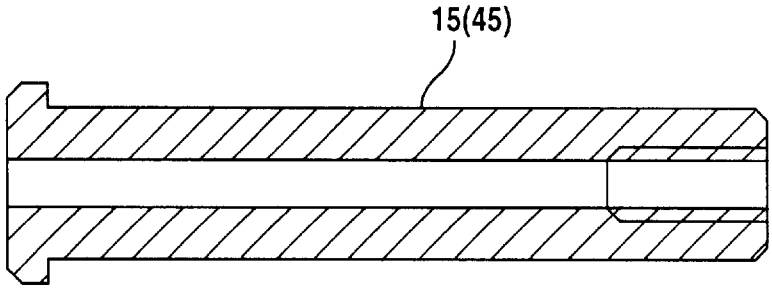
FIG. 16 is a cross-section of an example of a chuck sleeve.
Figure 17:
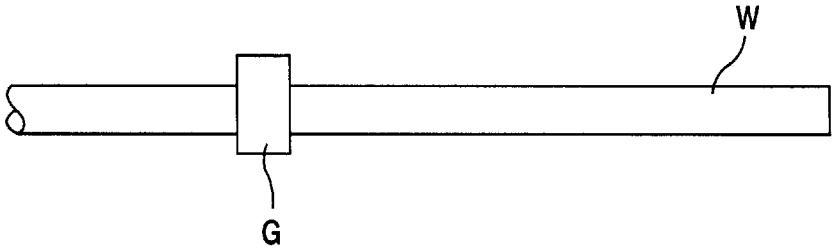
FIG. 17 is a schematic view of a diametrically expanded metal shaft.
Figure 18:
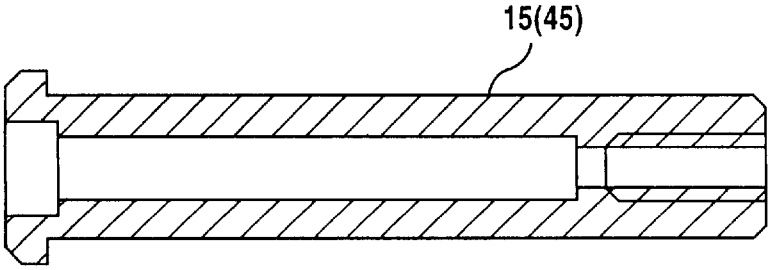
FIG. 18 is a cross-section of another type of chuck sleeve.
Figure 19:
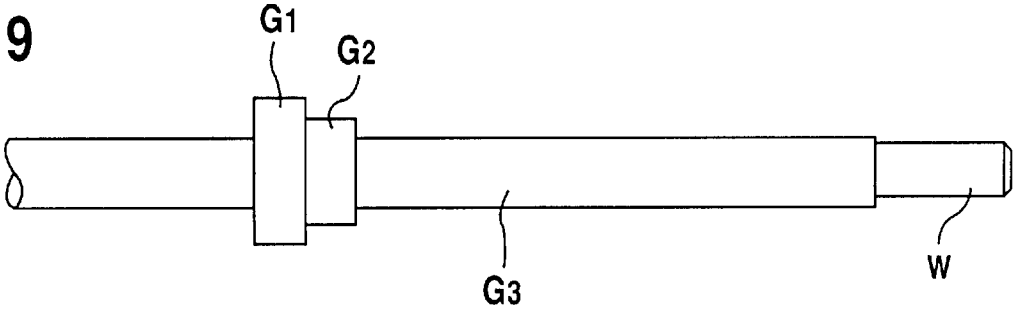
FIG. 19 is a cross-section of a finished metal shaft processed by use of the chuck sleeve of FIG. 18.

This is the same with the driver section (not shown). The chuck sleeve shown in FIG. 16 can produce a diametrically expanded portion G shown in FIG. 17. The diametrically expanded shaft shown in FIG. 18 has steps at $G_1$, $G_2$, and $G_3$. When chuck sleeves having different inside diameters are prepared regardless of their same outside diameter, they can be selectively applied to various metal shafts having different diameters. It is possible to employ an conventional chuck instead of the chuck sleeves described above.

Industrial Applicability of the Invention

The diametrically expanding apparatus of the invention easily obtains metal shaft having a diametrically expanded portion, and facilitates the formation of gears, cams and sprockets there without welding or bolting. The processed metal shafts can be immediately used as power transmission shafts and the like.

What is claimed is:

1. An apparatus of diametrically expanding a desired portion of a metal shaft, the apparatus comprising:

a driver section (5) which is rotatively driven by an electric motor with a workpiece held in a first sleeve thereof;

a driven section (30) having a second sleeve located opposite to the first sleeve of the driver section (5), the driven section (30) being capable of relative movement to and from the driver section (5);

a feeder unit (50) for effecting the relative movement of the driven section (30) to and from the driver section (5);

a bias means (80) for causing the second sleeve to decline with respect to the axis of the first sleeve of the driver section (5); and a press unit (70) for pressing the driven section (30) toward the driver section (5).

2. An apparatus as defined in claim 1, wherein the driven section (30) comprises a rotating shaft in its forward part so as to rotate around it, and wherein the bias means (80) rotates that portion of the driven section that is located backward from the rotating shaft.

3. An apparatus as defined in claim 1 or 2, wherein the rotating shaft is deviated outward from the center line of the driven section (30).

4. An apparatus as defined in claim 1 or 2, wherein at least one of the driver section or the driven section comprises a detachable chuck sleeve for holding a workpiece.

5. An apparatus as defined in claim 1 or 2, wherein the driver section is substituted by a rotary head of a known lathe.

* * * * *